US008397922B2

(12) United States Patent
Kahl et al.

(10) Patent No.: US 8,397,922 B2
(45) **Date of Patent: *Mar. 19, 2013**

(54) THEFT DETERRENT CAN DISPENSER

(76) Inventors: William Henry Kahl, Mason, OH (US); Robert C Best, Cincinnati, OH (US); David E Burbrink, Cold Spring, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/159,474

(22) Filed: Jun. 14, 2011

(65) Prior Publication Data

US 2011/0240569 A1 Oct. 6, 2011

Related U.S. Application Data

(63) Continuation of application No. 12/045,384, filed on Mar. 10, 2008, now Pat. No. 7,980,398.

(51) Int. Cl.
*A47F 7/00* (2006.01)

(52) U.S. Cl. ..... 211/59.2

(58) Field of Classification Search ..... 211/59.2, 211/135, 59.4, 51, 59.3, 175, 184; 221/303, 221/311, 107, 130, 266, 114, 116, 123, 124, 221/125, 247, 251, 255, 256, 279, 280; 312/303, 312/323, 315, 35, 61, 71, 72, 216, 217, 221; 108/60, 61

See application file for complete search history.

(56) References Cited

U.S. PATENT DOCUMENTS

| | | | | | |
|---|---|---|---|---|---|
| 493,087 | A | * | 3/1893 | Hayden | 221/124 |
| 660,797 | A | * | 10/1900 | Huelster | 312/303 |
| 924,351 | A | * | 6/1909 | Hitchcock | 221/303 |
| 1,015,722 | A | * | 1/1912 | Bezold | 312/303 |
| 1,112,562 | A | * | 10/1914 | Rogman | 211/80 |
| 1,117,338 | A | * | 11/1914 | Cox | 312/303 |
| 1,201,844 | A | | 10/1916 | Berry | |
| 1,520,970 | A | | 12/1924 | Smith | |
| 1,776,404 | A | * | 9/1930 | Wetzel | 312/303 |
| RE18,291 | E | | 12/1931 | Kaye | |
| 1,841,926 | A | * | 1/1932 | Zuehl | 221/75 |
| 1,993,451 | A | * | 3/1935 | Michaud | 221/311 |
| 2,049,383 | A | | 7/1936 | Frick | |
| 2,176,384 | A | | 10/1939 | Varney | |
| 2,353,393 | A | | 7/1944 | Fahey | |
| 2,353,394 | A | * | 7/1944 | Farmer | 211/59.2 |
| 2,376,960 | A | * | 5/1945 | Clem | 194/255 |
| 2,460,396 | A | | 2/1949 | Rifkin | |
| 2,522,896 | A | | 9/1950 | Rifkin et al. | |

(Continued)

FOREIGN PATENT DOCUMENTS

JP 2000282736 A * 10/2000

*Primary Examiner* — Darnell Jayne
*Assistant Examiner* — Joshua Rodden
(74) *Attorney, Agent, or Firm* — Wood, Herron & Evans, LLP

(57) ABSTRACT

A theft deterrent dispensing unit particularly for use with cans includes a conveyor section that leads to a dispensing head. A shroud extends over the forward edge of the conveying section. The dispensing head pivots downwardly allowing the leading can to be grasped without interference of the shroud. The rear edge of the dispensing head pivots upwardly, preventing the next adjacent can from moving immediately into the dispensing head until the dispensing head rotates back to a closed position. Likewise, when the dispensing head is rotated to an open position, a barrier is pulled down from the top of the shroud, again preventing an individual from reaching in and grabbing the next adjacent can. A locking mechanism is positioned on the side of the dispensing units to prevent two adjacent dispensing units from being opened at the same time. Finally, the speed at which the dispensing heads move from an open to a closed position is regulated to prevent rapid removal of cans from a single dispensing unit.

5 Claims, 6 Drawing Sheets

U.S. PATENT DOCUMENTS

| | | | | | |
|---|---|---|---|---|---|
| 2,784,872 | A | | 3/1957 | Lux | |
| 3,578,207 | A | | 5/1971 | Danow | |
| 3,753,507 | A | * | 8/1973 | James et al. | 414/276 |
| 4,269,326 | A | | 5/1981 | Delbrouck | |
| 4,336,892 | A | | 6/1982 | Cox et al. | |
| 4,577,780 | A | * | 3/1986 | Holland et al. | 221/125 |
| 4,682,825 | A | | 7/1987 | Crosslen | |
| 4,772,077 | A | | 9/1988 | Beam et al. | |
| 4,809,879 | A | | 3/1989 | Hanley | |
| 4,887,737 | A | | 12/1989 | Adenau | |
| 4,923,261 | A | * | 5/1990 | Attardo | 312/303 |
| 5,385,267 | A | | 1/1995 | Diamond et al. | |
| 5,454,485 | A | | 10/1995 | Dalziel | |
| 5,460,294 | A | | 10/1995 | Williams | |
| 5,579,952 | A | | 12/1996 | Fiedler et al. | |
| 5,665,304 | A | | 9/1997 | Heinen et al. | |
| 5,667,082 | A | | 9/1997 | Hamilton et al. | |
| 5,791,516 | A | * | 8/1998 | Wittern et al. | 221/301 |
| 5,992,651 | A | | 11/1999 | Shaw et al. | |
| 6,082,556 | A | | 7/2000 | Primiano et al. | |
| 6,142,316 | A | | 11/2000 | Harbour et al. | |
| 6,142,317 | A | | 11/2000 | Merl | |
| 6,149,031 | A | * | 11/2000 | Bauman et al. | 221/109 |
| 6,276,538 | B1 | | 8/2001 | Battaglia et al. | |
| 6,325,221 | B2 | | 12/2001 | Parham | |
| 6,347,710 | B1 | | 2/2002 | Ryan, Jr. et al. | |
| 6,352,174 | B1 | * | 3/2002 | Bauman et al. | 221/109 |
| 6,435,353 | B2 | | 8/2002 | Ryan, Jr. et al. | |
| 6,439,400 | B2 | * | 8/2002 | Battaglia et al. | 211/59.2 |
| 6,439,401 | B2 | * | 8/2002 | Battaglia et al. | 211/59.2 |
| 7,665,618 | B2 | * | 2/2010 | Jay et al. | 211/59.2 |

* cited by examiner

THEFT DETERRENT CAN DISPENSER

BACKGROUND OF THE INVENTION

Many expensive items that are stocked by stores encounter a problem referred to as "sweeping". In other words, a thief enters a store and takes multiple items off a shelf, or "sweeps" the shelf, and runs out the store. The quicker the thief can take multiple items, the less likely the thief will be caught and more items can be stolen.

There have been many systems developed to deter this. Many expensive items are place behind the counter so they must be accessed with the assistance of a clerk. Others are located in cases that allow only one item to be removed at a time, or limit the access of the product to the individual. Such structures are designed to require two hands to remove a single item, and prevent an individual from taking more than one item at a time.

This has been used extensively with products such as razor blades, and the like, but there is no system that is particularly suitable for canned goods. One type of canned good particularly vulnerable to theft is infant formula. This is very expensive and a thief can easily grab multiple cans from a standard store shelf at one time.

SUMMARY OF THE INVENTION

The present invention is premised on the realization that a theft deterrent case, primarily suited for cans, includes a conveyor section that leads to a dispensing head. The dispensing head pivots downwardly from a closed to an open position. When in the open position, only one can is available to be removed and the next can is prevented from sliding down into the dispensing head. A plurality of these units are generally positioned side by side. Each unit has a locking mechanism that prevents two adjacent units from being opened at the same time.

The objects and advantages of the present invention will be further appreciated in light of the following detailed description and drawings in which:

DETAILED DESCRIPTION

Figure 1:
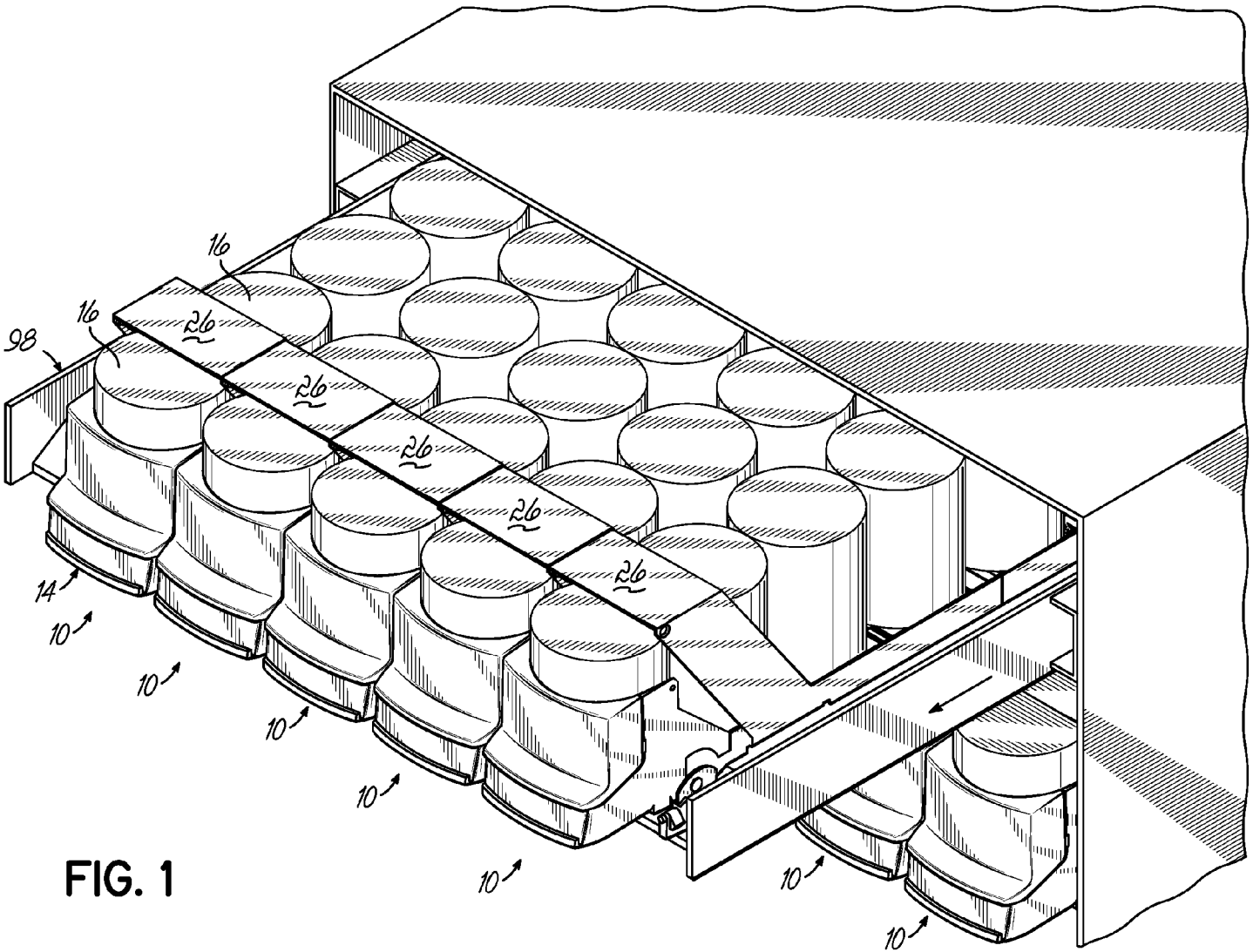
FIG. 1 is a perspective view of the present invention located on a pullout shelf.
Figure 2:
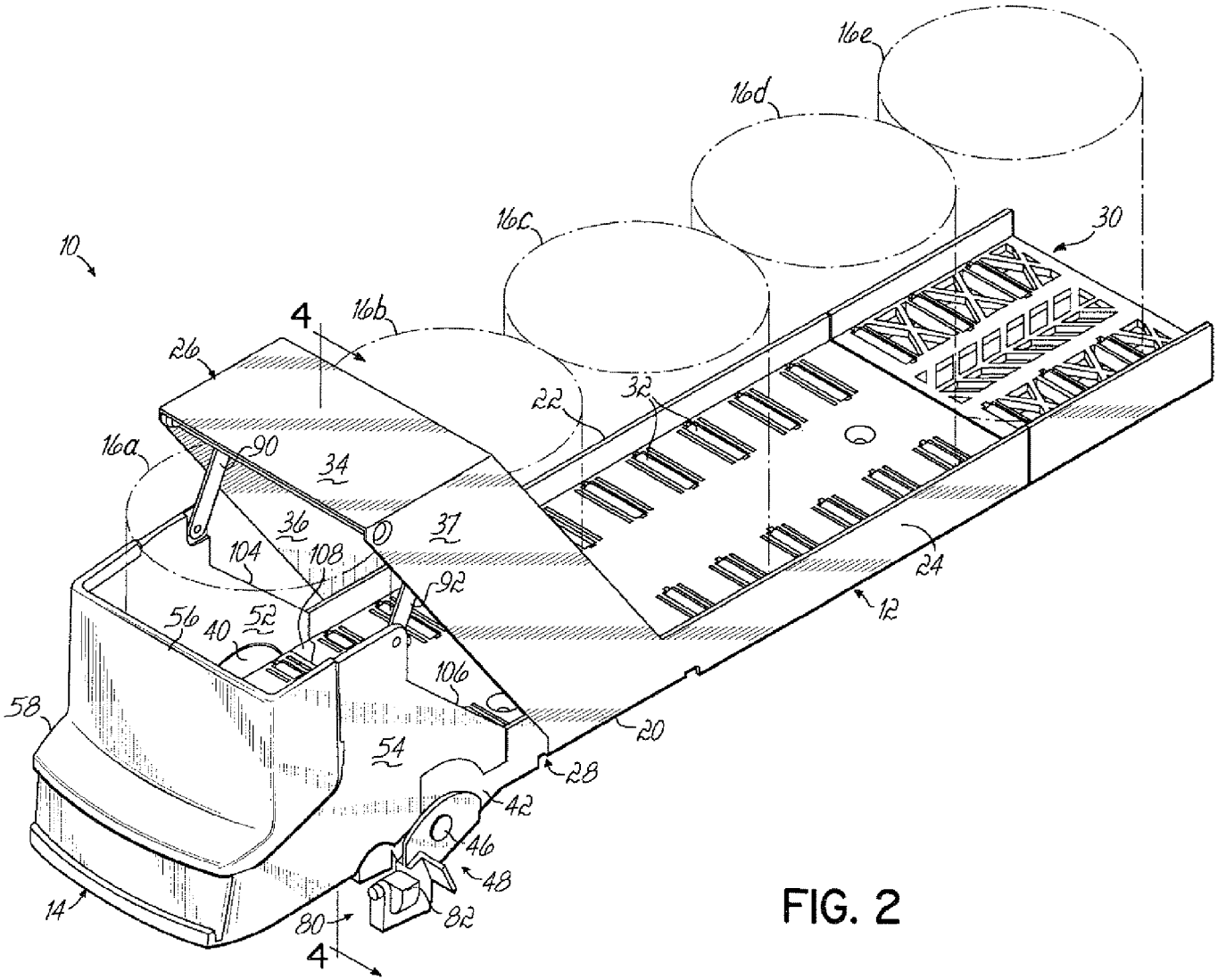
FIG. 2 is a perspective view of a single unit of the present invention.
Figure 3:
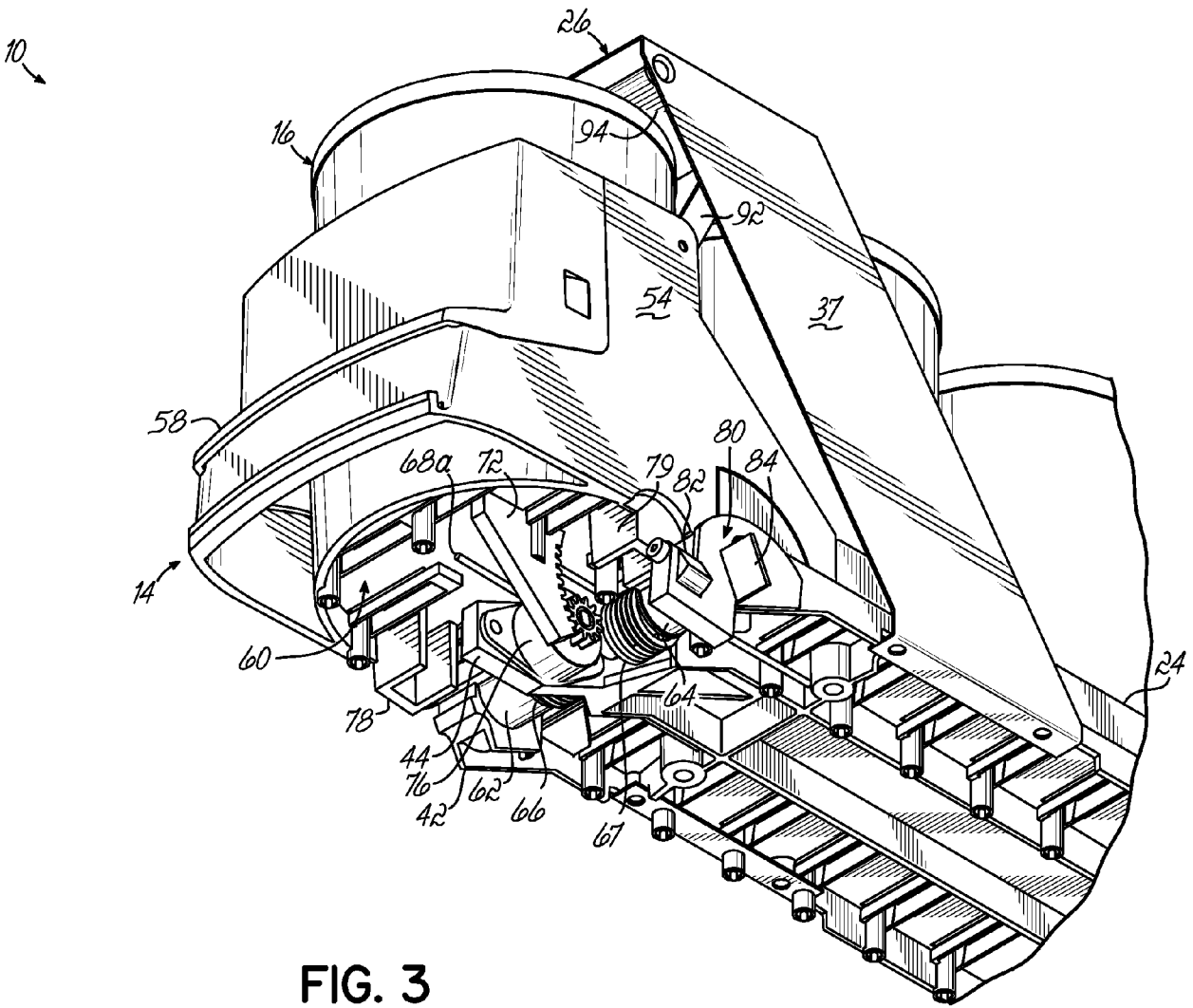
FIG. 3 is a bottom view of the dispense shown in FIG. 2, partially broken away.

According to the present invention, a dispensing unit 10, as shown in FIG. 2, includes a conveyor section 12 and a dispensing head section 14, which is adapted to dispense cans 16(*a*)-(*e*) (shown in phantom in FIG. 2). The conveyor section 12 incorporates a base 20 with first and second side walls 22 and 24. A forward portion 28 of the conveyor section 12 includes a shroud 26. The shroud 26 includes a top 34 and two side members 36 and 37.

The base 20 further includes a plurality of rollers 32 adapted to permit the cans 16 to slide from the rear section 30 of the conveyor to the forward section 28 of the conveyor.

A forward portion 28 of conveyor section 12 includes first and second side cantilevered tabs 40 and 42, and a central cantilevered tab 44, each of which extends below the conveyor section 12. As described below, the dispensing head 14 pivotally attaches to tabs 40, 42, and 44.

The dispensing head 14 includes a base 50 which is coplanar with the base 20 of the conveyor section 12. Base 50 includes a plurality of rollers 51 which allow the cans to slide from the conveyor section 12 to the front wall 56 of the dispensing head 14. The dispensing head 14 has side walls 52 and 54. Forward of front wall 56 is a protruding portion 58 which is used to operate the dispensing head 14, as described below.

A bottom 60 of dispensing head 14 includes first and second hollow sleeves 62 and 64 located between the first side cantilevered tab 40 and central tab 44 and between the central cantilevered tab 44 and the second side cantilevered tab 42, respectively. A rod 46 extends from the first side cantilevered tab 40 through sleeve 62 through the central cantilevered tab 44 and sleeve 64, and, finally, to the second cantilevered tab pivotally connecting the dispensing head 14 to the conveyor section 12.

Figure 4:
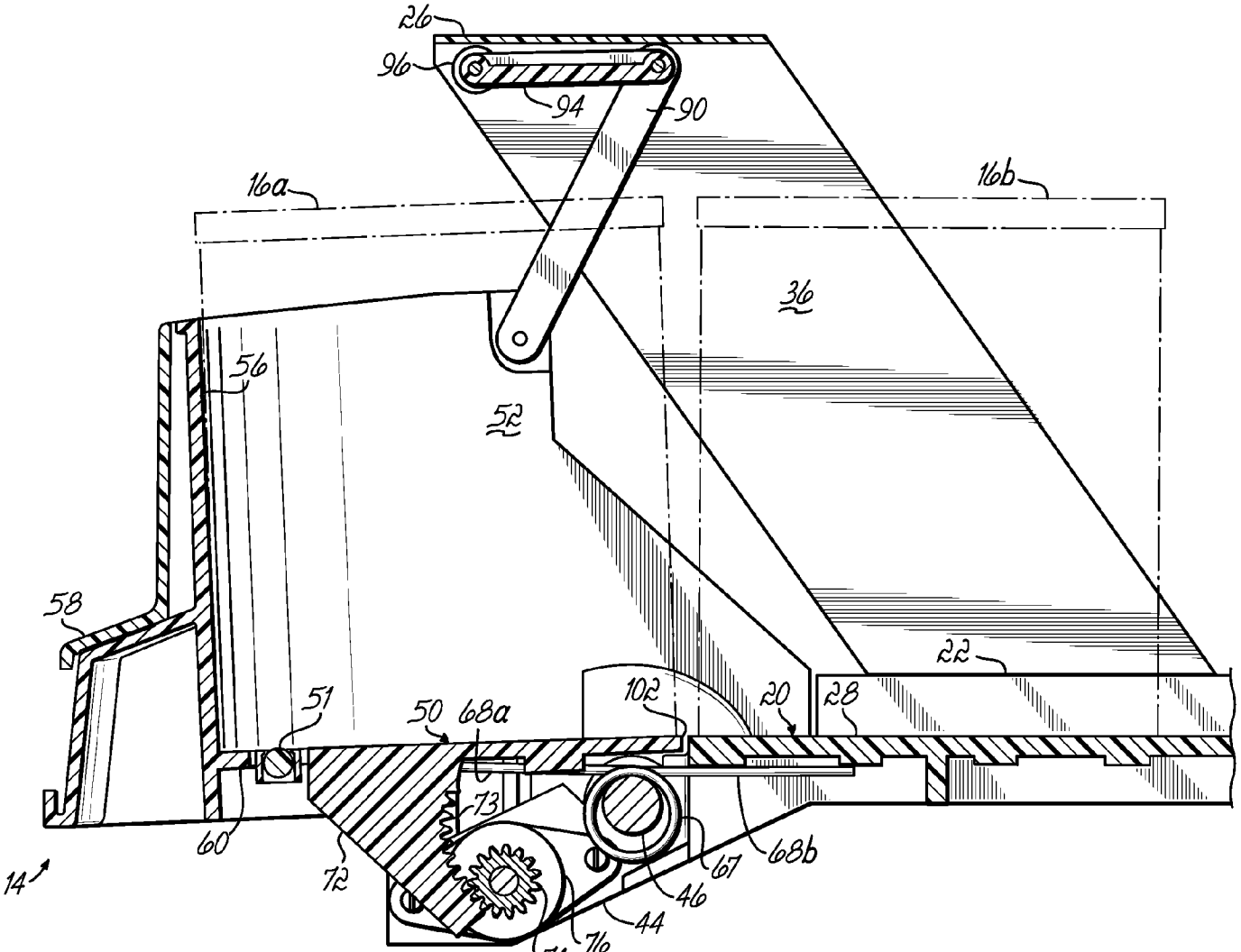
FIG. 4 is a cross sectional view taken at lines 4-4 of FIG. 2 with the dispensing head in the closed position.

Two coil springs 66 and 67 are positioned adjacent sleeves 62 and 64 on either side of central tab 44 and around rod 46. Coil springs 66 and 67 have forward and rear ends 68*a* and 68*b* and 70*a* and 70*b*, respectively. The ends of these springs bias the dispensing head 14 in the closed position, as shown in FIG. 4 and FIG. 2.

Extended downwardly from the bottom 60 of dispensing head 14 is a curved tongue member 72 having a plurality of teeth 73. These teeth engage a gear 74 attached to a damping member 76 fixed to the central cantilevered tab 44 of conveyor section 12. The damping member 76 is simply a closed cylinder filled with a viscous material. The gear 74 is fixed to a shaft 75 (FIGS. 4 and 5), which, in turn, is fixed to a paddle member (not shown) within the damping member 76. Thus, as the gear 74 rotates, this paddle member rotates in the viscous fluid (not shown), which, in effect, slows the movement of the dispensing head 14. This acts as a speed regulating member.

Figures 6, 7A, 7B:
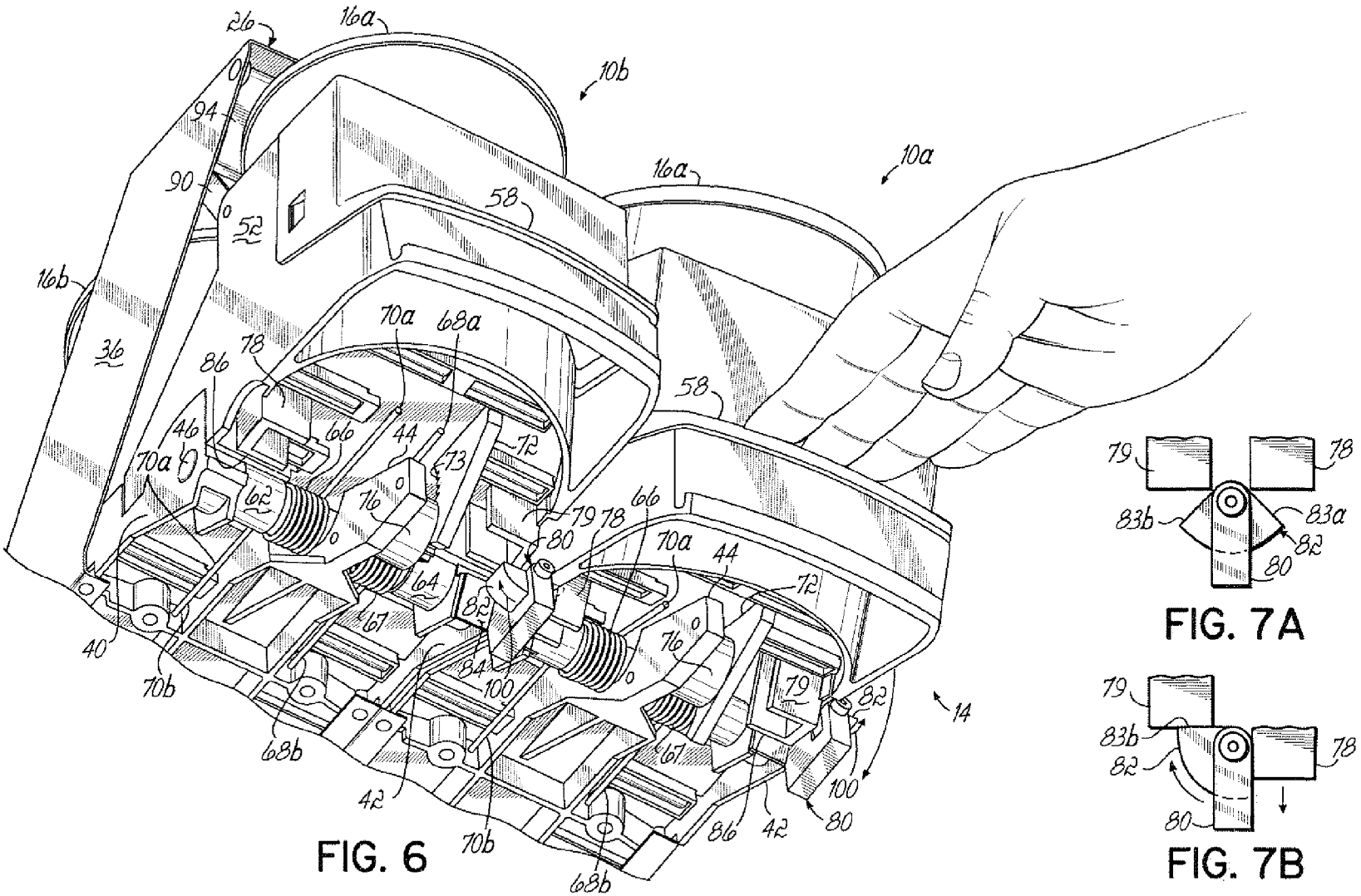
FIG. 6 is a bottom view of two adjacent dispensing units partially broken away.
FIGS. 7A and 7B are diagrammatic depictions of the locking mechanism of two adjacent dispensers.

The bottom 60 of the dispensing head 14 further includes first and second downwardly extending posts 78 and 79, which are on opposite sides of the dispensing head 14. Attached to a forward side edge 48 of the conveyor section is a locking member 80. Locking member 80 includes a pivoting quartercircular wedge 82, which, when in the neutral position, as shown in FIG. 7A, has one side 83(*a*) resting below the post 78 of a right dispensing unit 10(*a*) and one side 83(*b*) resting below post 79 of the adjacent left dispensing unit 10(*b*). As shown in FIG. 7B, as a left dispensing head 14 of unit 10(*a*) moves to the open position, post 78 moves downwardly, causing the wedge 82 to rotate outwardly away from the post 78. When wedge 82 rotates away from post 78, it rotates under a post 79 of the next adjacent left unit 10(*b*), preventing the dispenser head 14 of that unit 10*b* from pivoting to an open position. The lock member 80 further includes a tab 84. Tab 84 is designed to engage post 78 of an adjacent dispensing unit and align the adjacent unit.

A further security mechanism is included in the shroud 26. Extended from first and second side walls 36,37 of shroud 26 are linkages 90 and 92 which extend to either side of a panel

Figure 5:
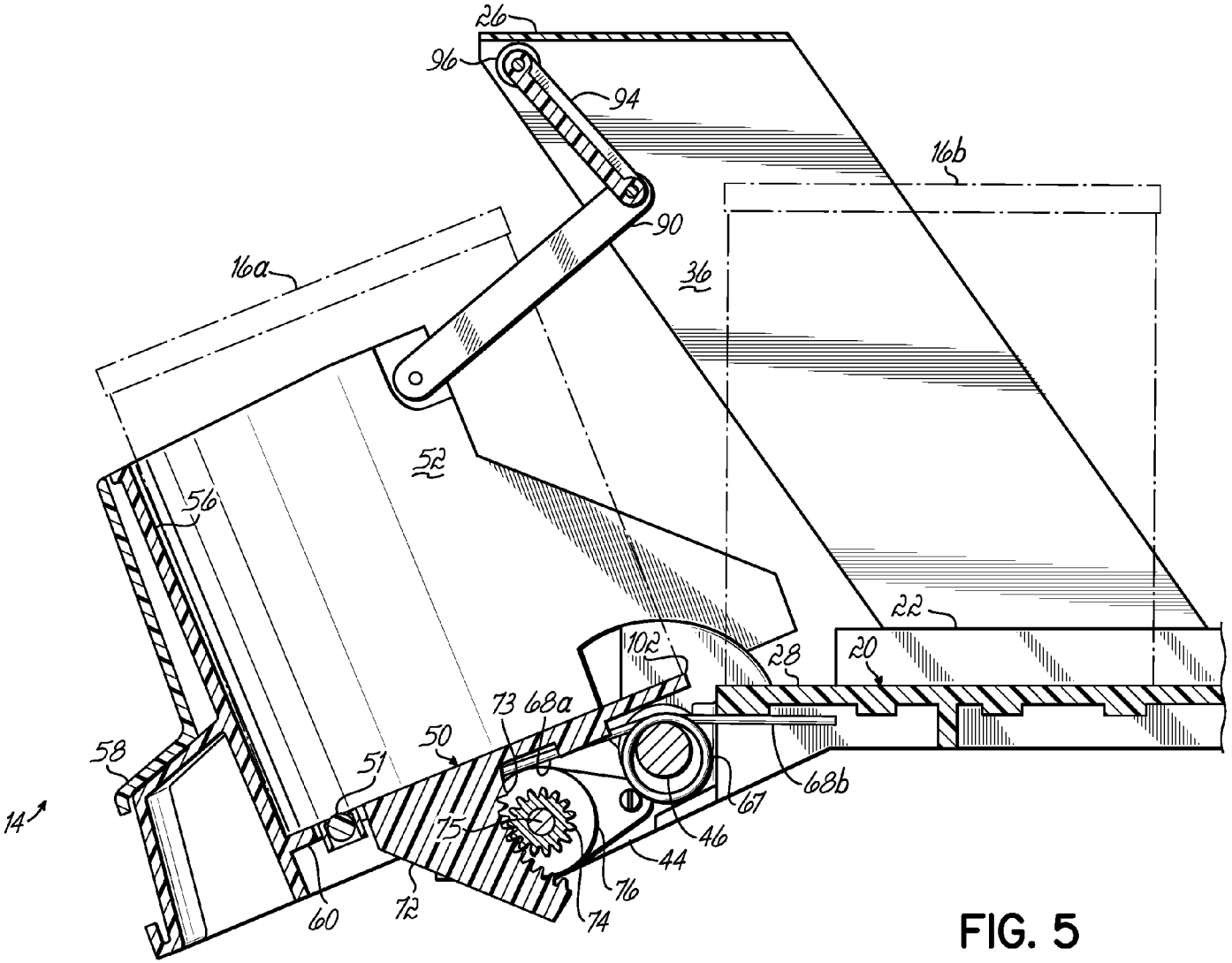
FIG. 5 is the same view as FIG. 4 with the dispensing head in the open position.

94, which has a forward edge 96 pivotally attached to the side walls 36 and 37 of shroud 26. When dispensing head 14 is pivoted to the open position, the side walls 52,54 pull the linkages 90 and 92, in turn pulling panel 94 downwardly. When panel 94 is pulled down, as shown in FIG. 5, first can 16(*a*) can be selected, but the next can 16(*b*) on the conveyor section cannot be removed. Access is blocked by panel 94. When the dispenser returns to a closed position, panel 94 pivots upwardly, allowing can 16(*b*) to move forward onto the dispensing unit 14.

Typically, a plurality of dispensing units 10 would be positioned side by side on a pull-out shelf 98. The shelf 98 can be positioned at a slight angle to cause the cans to slide forwardly, or the units themselves can be positioned on an angled support (not shown) to ensure gravity feed.

In use, the units 10 are loaded with cans 16. These units 10 are positioned side by side. If a customer desires to take a can 16(*a*) from the shelf, the protruding portion 58 is pushed downwardly, which tilts the forward most can 16(*a*) so that it can be grasped without interference with the shroud 26. This is shown more particularly in FIG. 5. As shown in FIGS. 6 and 7B, post 78 will then push the wedge 82 of lock member 80 in the direction of arrow 100. The wedge 82 will be directly below post 79 of the left adjacent dispensing unit 10(*b*), which prevents the dispensing head 14 of that unit from pivoting to an open position. Thus, only the first unit 10*a* can be opened.

Further, when the head unit 14 is pivoted downwardly, the rear edge 102 of the base of the dispensing head 14 rises above the plane of the base 20 of the conveyor section 12. This prevents the next adjacent can 16(*b*) from sliding forwardly. Further, when dispensing head 14 is in the open position, linkages 90 and 92 will be pulled downwardly, which, in turn, will cause the panel 94 to be pulled downwardly. This prevents an individual from reaching in and grabbing the next adjacent can 16(*b*).

Once the individual releases the dispensing head 14, the springs 66 and 67 urge the dispensing head 14 to the closed position. As this occurs, the base 50 and the curved tongue 72 will move upwardly, which will cause the gear 74 of damping member 76 to rotate. The damping member 76 will, in effect, govern the speed at which the dispensing head 14 closes, which will then establish an interval of time required before the next can be removed from the same unit or adjacent units.

To restock the dispensers 10, the shelf 98 is simply pulled out, allowing access to the rear portion of the conveyor, which can then be loaded with additional cans. Generally, shelf 98 will include a lock (not shown), which prevents a thief from puling out the shelf.

Thus, the present invention provides for easy dispensing of cans. Further, it prevents an individual from taking two cans from adjacent units at the same time, and, further, prevents an individual from taking multiple cans from the same dispensing unit without allowing the dispensing head to open and close totally. Finally, due to the fact that a governor or brake is provided on the dispensing head, the time required for the unit's head to close is controlled.

This has been a description of the present invention along with the preferred method of practicing the present invention. However, the invention itself should only be defined by the appended claims, WHEREIN I CLAIM.

What is claimed is:

1. A plurality of dispensers for dispensing cans positioned side by side on a shelf, each of said dispensers including a conveyor section and a dispensing head pivotally attached to a forward section of said conveyor section; and a locking member extending below each said dispensing head, each said locking member having a member which pivots laterally when one of said dispensing heads is pivoted to an open position thereby preventing another one of said dispensing heads of an adjacent one of said dispensers from pivoting to an open position and wherein the dispensing head of each of said dispensers has first and second posts below a base of said dispensing head wherein one of said posts forces one of said members to pivot laterally when said head unit is in an open position and wherein said members pivot beneath posts of adjacent ones of said dispensers preventing said dispensing heads of said adjacent ones of dispensers from pivoting to an open position.

2. The plurality of dispensers claimed in claim 1 wherein each of said plurality of dispensers includes a shroud extending over a forward portion of said conveyor section and a stop member pivotally connected to said shroud member and further connected to said dispensing head by a linking mechanism whereby moving said dispensing head to an open position causes said stop member to extend downwardly preventing access to a next adjacent can.

3. The plurality of dispensers claimed in claim 1 wherein the base of the dispensing head of each of said dispensers has a rear edge which raises above a plane of said conveyor section when said dispensing head is pivoted to said open position thereby preventing cans from sliding from said conveyor section to said dispensing head when said dispensing head is pivoted to said open position.

4. The plurality of dispensers claimed in claim 1 wherein the dispensing head of each of said dispensers is spring biased to be in a closed position.

5. The plurality of dispensers claimed in claim 3 wherein each of said dispensing heads of each of said dispensers is attached to a speed regulator.

* * * * *

UNITED STATES PATENT AND TRADEMARK OFFICE

CERTIFICATE OF CORRECTION

PATENT NO. : 8,397,922 B2
APPLICATION NO. : 13/159474
DATED : March 19, 2013
INVENTOR(S) : William H. Kahl et al.

It is certified that error appears in the above-identified patent and that said Letters Patent is hereby corrected as shown below:

In the Claims:

Claim 1

| | | |
|---|---|---|
| Col. 4, lines 28-29<br>"heads of said adjacent ones of dispensers" | should read | --heads of adjacent ones of said dispensers-- |

Signed and Sealed this
Ninth Day of July, 2013

Teresa Stanek Rea
*Acting Director of the United States Patent and Trademark Office*